US009338865B2

(12) United States Patent
Kunze

(10) Patent No.: US 9,338,865 B2
(45) Date of Patent: May 10, 2016

(54) GAS LIGHT SYSTEM AND METHOD

(75) Inventor: John W. Kunze, Colorado Springs, CO (US)

(73) Assignee: John W. Kunze, Colorado Springs, CO (US)

( * ) Notice: Subject to any disclaimer, the term of this patent is extended or adjusted under 35 U.S.C. 154(b) by 168 days.

(21) Appl. No.: 13/435,172

(22) Filed: Mar. 30, 2012

(65) Prior Publication Data

US 2014/0327370 A1 Nov. 6, 2014

Related U.S. Application Data

(60) Provisional application No. 61/516,189, filed on Mar. 31, 2011.

(51) Int. Cl.

| | |
|---|---|
| ***H05B 41/28*** | (2006.01) |
| ***H01J 61/04*** | (2006.01) |
| ***H01J 61/10*** | (2006.01) |
| ***H01J 61/32*** | (2006.01) |
| ***H01J 61/70*** | (2006.01) |
| ***H05B 41/282*** | (2006.01) |
| *H05B 41/232* | (2006.01) |

(52) U.S. Cl.

CPC ..... *H05B 41/28* (2013.01); *H01J 61/04* (2013.01); *H01J 61/103* (2013.01); *H01J 61/32* (2013.01); *H01J 61/70* (2013.01); *H05B 41/2828* (2013.01); *H05B 41/2325* (2013.01)

(58) Field of Classification Search

USPC ..... 315/46–50, 94–107, 112–118, 291, 315/297, 307–312, 277

See application file for complete search history.

(56) References Cited

U.S. PATENT DOCUMENTS

| | | | | |
|---|---|---|---|---|
| 5,180,953 | A * | 1/1993 | Hirata et al. | 315/241 S |
| 6,268,697 | B1 * | 7/2001 | Nishida et al. | 313/607 |
| 6,892,029 | B2 * | 5/2005 | Tsuchida et al. | 396/200 |
| 2002/0074953 | A1 * | 6/2002 | Lovell | H01J 61/56 315/248 |
| 2005/0264236 | A1 * | 12/2005 | Lloyd et al. | 315/200 A |

* cited by examiner

*Primary Examiner* — Tuyet Vo

(74) *Attorney, Agent, or Firm* — Samuel M. Freund; Cochran Freund & Young, LLC

(57) ABSTRACT

A writing gas light system has a gas tube with a first end and a second end. A first cathode is attached to a first end of the gas tube and a second cathode is attached to a second end of the gas tube. An isolated conductor runs along a length of the gas tube and is electrically attached to the second cathode. A light ballast is coupled to the first cathode and to the isolated conductor. In one embodiment, the system has a digitally controlled ballast. The gas discharge ballast has an output applied to the gas tube whose energy can be adjusted. The system has a balanced center tap transformer. The secondary of the transformer is tied to ground through a ground fault detection circuit.

6 Claims, 3 Drawing Sheets

GAS LIGHT SYSTEM AND METHOD

RELATED APPLICATIONS

The present invention claims priority on provisional patent application Ser. No. 61/516,189, filed on Mar. 31, 2011, entitled "Gas Discharge Light Ballast with Improved Write Affect" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Neon lights and other ionized gas lighting systems have been used for years. Most commercial neon lights are either on or off. A small number of them are blinking signs. There has been a desire to have neon signs that have a write effect. The write effect means that the sign would light up at one end of the gas tube and the portion of the gas tube that was lit would progressively increase over a controlled time period as if someone were drawing out the sign. It would also be useful if neon signs could have a reverse write effect. There have been attempts to incorporate a write effect into neon signs. For instance, one proposed solution used a single cathode gas tube and a natural ground. Unfortunately, the write effect or handwriting effect produced was erratic.

Thus there exists a need for a gas light system that has the ability to blink and the ability to produce a consistent write effect.

BRIEF SUMMARY OF INVENTION

A writing gas light system that overcomes these and other problems includes a gas tube having a first end and a second end. A first cathode is attached to a first end of the gas tube and a second cathode is attached to a second end of the gas tube. An isolated conductor runs along a length of the gas tube and is electrically attached to the second cathode. A light ballast is coupled to the first cathode and to the isolated conductor. In one embodiment, the system has a digitally controlled ballast. The gas discharge ballast has an output applied to the gas tube whose energy can be adjusted. In one embodiment, the energy is adjusted by changing the duty cycle of a 20 KHz pulse width modulated signal. In another embodiment, the energy of the signal is adjusted by changing the amplitude or the input signal. In yet another embodiment, the energy of the input signal is adjusted using a combination of the duty cycle and the input voltage. In one embodiment, the system has a balanced center tap transformer. The secondary of the transformer is tied to ground through a ground fault detection circuit.

The isolated conductor provides a more consistent impedance for the gas tube and as a result the write effect can be more accurately controlled. The digital control of the duty cycle of the pulse width modulated signal provides a more accurate input energy than analog systems. The ability to adjust the amplitude provides a flexible approach to increasing and decreasing the energy of the input signal. The system also has the ability to blink a neon or other ionized gas light system as well as produce a consistent write and un-write function.

DETAILED DESCRIPTION OF THE INVENTION

The invention is directed to a writing gas light system that has a gas tube with a first end and a second end. A first cathode is attached to a first end of the gas tube and a second cathode is attached to a second end of the gas tube. An isolated conductor runs along a length of the gas tube and is electrically attached to the second cathode. A light ballast is coupled to the first cathode and to the isolated conductor. In one embodiment, the system has a digitally controlled ballast. The gas discharge ballast has an output applied to the gas tube whose energy can be adjusted. In one embodiment, the energy is adjusted by changing the duty cycle of a 20 KHz pulse width modulated signal. In another embodiment, the energy of the signal is adjusted by changing the amplitude or the input signal. In yet another embodiment, the energy of the input signal is adjusted using a combination of the duty cycle and the input voltage. In one embodiment, the system has a balanced center tap transformer. The secondary of the transformer is tied to ground through a ground fault detection circuit.

The isolated conductor provides a more consistent impedance for the gas tube and as a result the write effect can be more accurately controlled. The digital control of the duty cycle of the pulse width modulated signal provides a more accurate input energy than analog systems. The ability to adjust the amplitude provides a flexible approach to increasing and decreasing the energy of the input signal. The system also has the ability to blink a neon or other ionized gas light system as well as produce a consistent write and un-write function.

Figure 1:
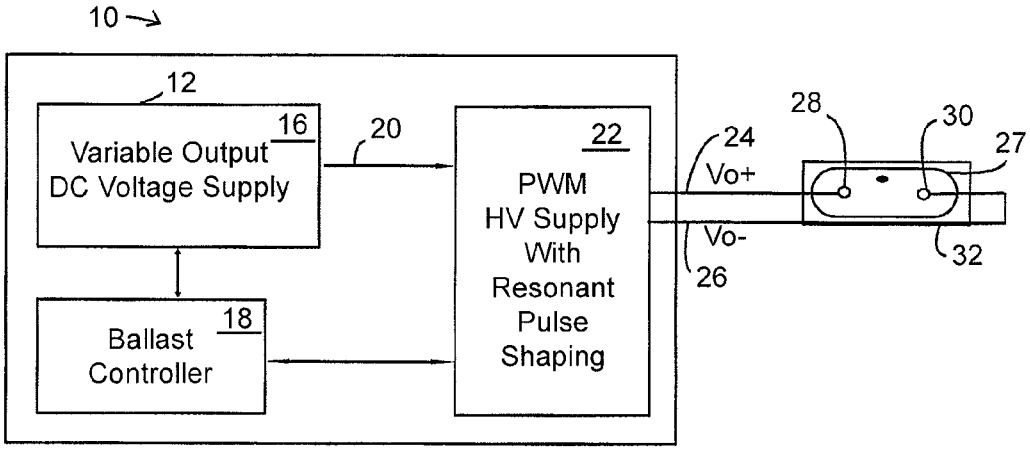
FIG. 1 is a block diagram of a gas light system in accordance with one embodiment of the invention.

FIG. 1 is a block diagram of a gas light system 10 in accordance with one embodiment of the invention. The system 10 has a gas light ballast 12 that drives a gas tube 14. The gas light ballast 12 has a variable output DC voltage supply 16. A ballast controller 18 controls the output level 20 of the DC voltage supply 16. The ballast controller 18 may be a microprocessor or microcontroller. The ballast controller is coupled to a pulse width modulated high voltage supply 22. The output of the pulse width modulated high voltage supply 22 is a balanced signal Vd+ 24 and Vd− 26. These signals are applied to the gas tube 14. The gas tube 14 has a first cathode 28 at one end of the gas tube 14 and a second cathode 30 at a second end of the gas tube 14. The first cathode 28 is electrically connected to the drive signal 24. The second cathode 30 is coupled to an isolated conductor 32 that runs along the outer length of the gas tube 14. One end of the isolated conductor 32 is electrically connected to the second cathode 30 and the second end of the isolated conductor 32 is connected to the drive signal 26.

The ballast controller 18 is the intelligence that determines if the gas tube blinks or writes forward from the first cathode to the second cathode or un-writes back to the first cathode and at what speed this happens. All of these features are called lighting effects. The ballast controller 18 determines the output of the DC voltage supply, which determines the amplitude of the drive signals 24, 26. The ballast controller 18 also controls the duty cycle of the drive signals 24, 26 through the pulse width modulated high voltage supply 22. The high voltage supply 22 also steps up the voltage. In one embodiment, the DC voltage supply 16 has an output voltage from zero volts to two hundred volts. The high voltage supply 22 steps this up to between zero and ten thousand volts. The ballast controller 18 also varies the duty cycle of the pulse width modulated signals 24, 26. In one embodiment, the pulse width modulated signals have a frequency of twenty kilohertz. The ballast controller 18 determines the input energy to the gas discharge tube 14 by varying either amplitude of the drive signals 24, 26 or their duty cycle or both. The isolated conductor 32 provides a capacitive return path along the gas tube 14. This capacitive return path allows the gas tube to light only a portion of its length. By varying the input energy the length of the gas tube is selective lit up. The isolated conductor allows this to be accomplished in a consistent manner to produce the desired lighting effects. If a blinking light is desired sufficient energy is applied to light the whole gas tube in an on off pattern.

In one embodiment, a computer and appropriate software are used to configure the ballast controller. In operation, the computer is used to vary the duty cycle and the drive voltage over time until the operator achieves the desired light effect. Once the desired lighting effect is achieved the control signal is stored in the ballast controller.

Figure 2:
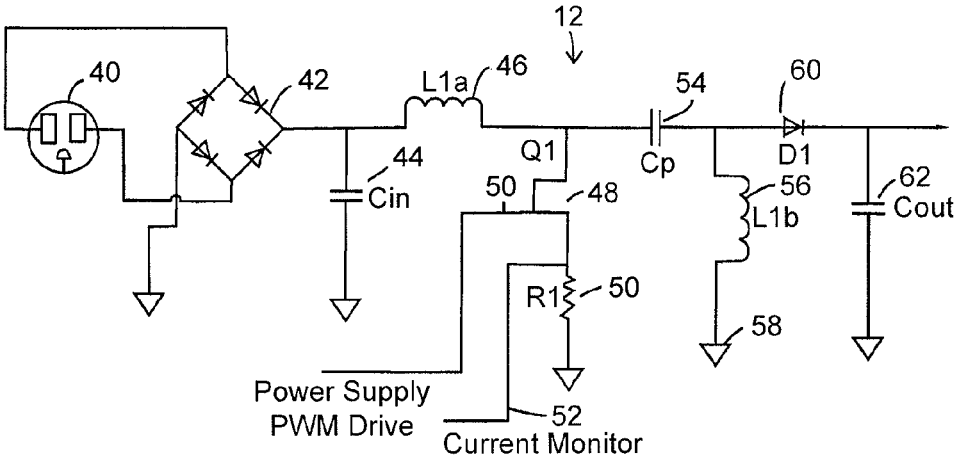
FIG. 2 is a circuit diagram of a variable output DC voltage supply in accordance with one embodiment of the invention.

FIG. 2 is a circuit diagram of a variable output DC voltage supply 12 in accordance with one embodiment of the invention. The variable output DC voltage supply, 12, may be any of a wide variety of known linear or switch mode power supply designs. The embodiment shown here is a pulse width controlled power supply. The DC supply 12 has an AC voltage source 40 connected to a rectifier 42. An input capacitor 44 is connected in parallel with the rectifier 42. An input inductor 46 is in series with the rectifier 42. A control transistor 48 is in series with a resistor 50 and together they are in parallel with the input capacitor 44. The gate 50 of the control transistor 48 is connected to ballast controller 18 drive signal Q1 (see FIG. 4). The current monitor line 52 is connected to the ballast controller 18. The source of the transistor 48 is connected to a second capacitor 54. The other end of the capacitor is connected to a second inductor 56 which is coupled to ground 58. An output diode 60 is in series with the second capacitor 54. An output capacitor 62 is connected to the output of the diode 60 and coupled to ground.

Figure 3:
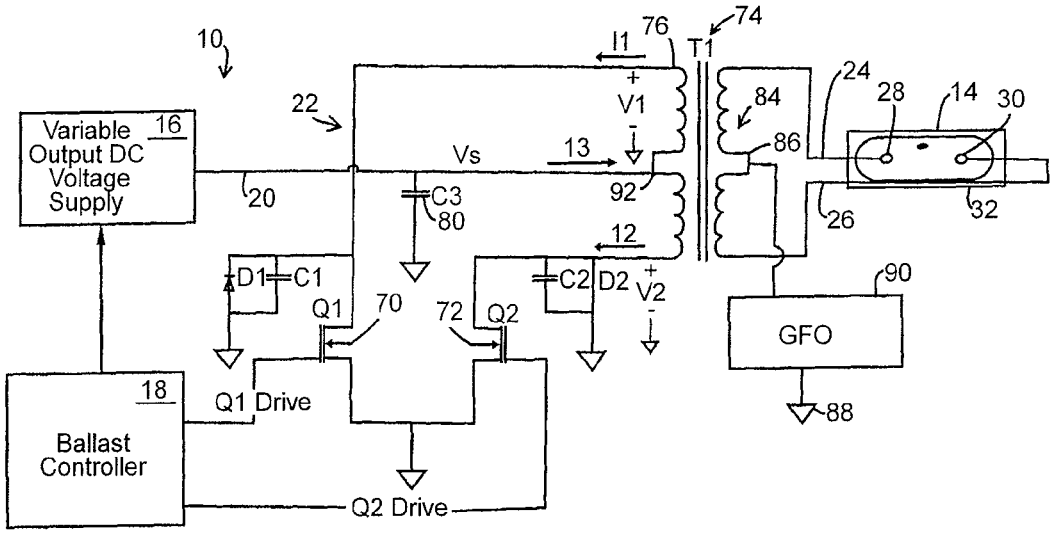
FIG. 3 is a circuit and block diagram of a gas light system in accordance with one embodiment of the invention.

FIG. 3 is a circuit and block diagram of a gas light system 10 in accordance with one embodiment of the invention. This figure shows an example of a circuit for the pulse width modulated high voltage supply 22. The high voltage supply 22 is controlled by a pair of drive transistors 70, 72 that selectively create a conductive path through the balanced transformer 74 primary coil 76. The transformer 74 has a center tapped primary 76 with the center tap being driven by the output 20 of the variable output DC power supply 16. The capacitor C3, 78 is connected to the center tap 82 of the transformer primary 76 and acts to supply and sink surge currents to and from the primary center Tap 82. Transistors Q1 and Q2 are turned on and off in quadrature phase driven by the ballast controller 18. When Q1 is in the on state, Q2 will be in the off state. Diode D1 and capacitor C1 are connected to the same side of transformer T1 primary as Q1. Diode D2 and capacitor C2 are connected to the opposite side of the transformer primary 76. Diodes D1 and D2 along with capacitors C1 and C2 handle transformer T1 primary currents when both Q1 and Q2 are in the off state. The output of the HV transformer, T1, may be balanced with a center tap referenced to ground, or unbalanced with one winding referenced to ground (no center tap). The output of transformer, T1, drives the gas tube 14. The secondary 84 of the transformer 74 has a center tap 86 tied to ground 88 through a ground fault detection circuit 90. Tying the center tap 86 to ground creates a pair of balanced output signals 24, 26.

In a one embodiment of the invention, the ballast controller 18 is a microprocessor based controller such as Microchip PIC18F4431 microcontroller having these features:

4 independent pulse width modulators

Figure 4:
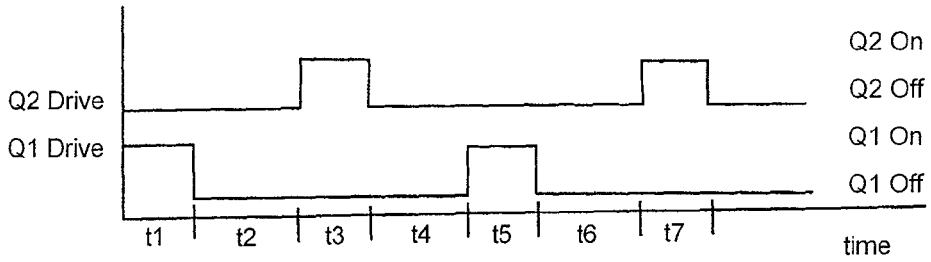
FIG. 4 is a timing diagram of the drive signals from the ballast controller in accordance with one embodiment of the invention.

Hardware fault protection on the pulse width modulators 9 channel, 10-bit, ND converter General purpose digital I/O FIG. 4 is a timing diagram of the drive signals from the ballast controller in accordance with one embodiment of the invention. The figure shows the quadrature phase drive signal for Q1 and Q2 from the ballast controller 18. Time periods t1 and t5 show periods of time when transistor Q1 is driven on to the conduction state. Time periods t3 and t7 show periods of time when transistor Q2 is driven on to the conduction state. Time periods t2, t4, t6, and t7 show time periods when both Q1 and Q2 are in the off or non-conduction state. In normal operation, the ballast controller 18 will control the width of the transistors on and off periods (pulse width modulation) and the pulse period. During normal operation the off time periods t2, t4, t6, and t7 will be a significant portion of the transistor drive cycle.

Figure 5:
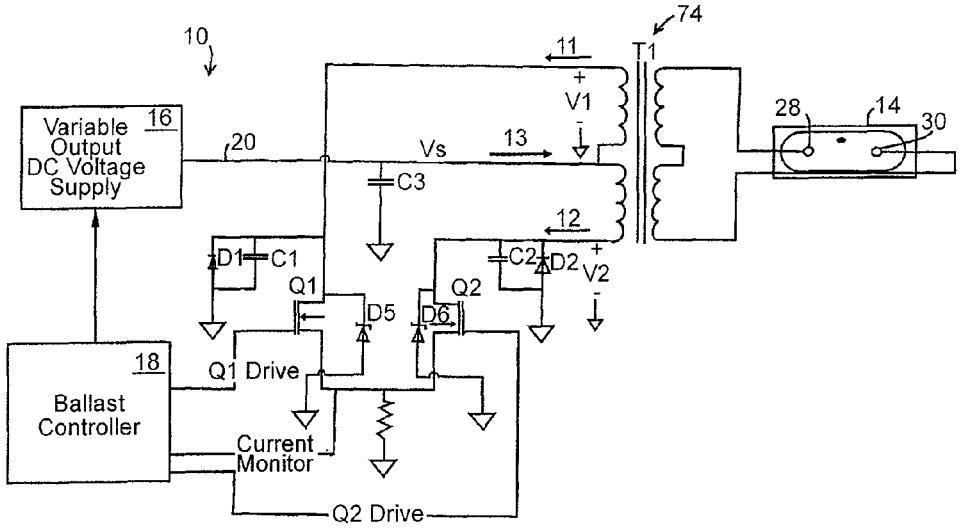
FIG. 5 is a circuit and block diagram of a gas light system in accordance with one embodiment of the invention.

FIG. 5 is a circuit and block diagram of a gas light system 10 in accordance with one embodiment of the invention. This figure shows an alternative embodiment of the pulse width modulated high voltage supply 22. This embodiment includes voltage transient protection diodes D5 and D6. These diodes protect transistors Q1 and Q2 from switching transient voltages and currents. Optional resistor R1 provide current monitor capability for the ballast controller 18.

Figure 6:
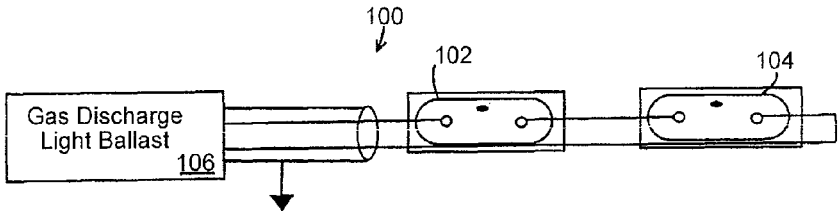
FIG. 6 is a block diagram of a gas light system in accordance with one embodiment of the invention.

FIG. 6 is a block diagram of a gas light system 100 in accordance with one embodiment of the invention. This figure shows that multiple gas tubes 102, 104 may be connected to a single gas light ballast 106.

Thus there has been described a gas light system that provides a consistent reliable write effect as well as other lighting effects. In addition, the system provides for ground fault detection.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A writing gas light system, comprising:

a gas tube having a first end and a second end, a first cathode at a first end of the gas tube and a second cathode at a second end of the gas tube;

an isolated conductor running along a length of the gas tube and directly electrically connected to the second cathode; and a light ballast coupled to the first cathode and to the isolated conductor, and comprising a variable output DC voltage supply, and a pulse width modulated high voltage supply connected to the variable output DC voltage supply;

wherein the light ballast has a variable output voltage and a variable duty cycle.

2. The writing gas light system of claim 1, wherein the light ballast includes a ballast controller coupled to the DC voltage supply.

3. The writing gas light system of claim 2, wherein the ballast controller controls the variable output voltage and the variable duty cycle output.

4. The writing gas light system of claim 1, wherein the pulse width modulated high voltage supply has a balanced transformer.

5. The writing gas light system of claim 4, further including a center tap of a secondary of the balanced transformer connected to ground.

6. The writing gas light system of claim 5, further including a ground fault detection circuit connected to the center tap of the secondary of the balanced transformer.

* * * * *